US011732915B2

(12) United States Patent
Lin

(10) Patent No.: US 11,732,915 B2
(45) Date of Patent: Aug. 22, 2023

(54) WIND PRESSURE-DRIVEN AIR INTAKE DEVICE

(71) Applicant: Jason Lin, Fremont, CA (US)

(72) Inventor: Jason Lin, Fremont, CA (US)

( * ) Notice: Subject to any disclaimer, the term of this patent is extended or adjusted under 35 U.S.C. 154(b) by 230 days.

(21) Appl. No.: 17/190,406

(22) Filed: Mar. 3, 2021

(65) Prior Publication Data

US 2022/0282875 A1 Sep. 8, 2022

(51) Int. Cl.
*F24F 7/02* (2006.01)

(52) U.S. Cl.
CPC ..... *F24F 7/02* (2013.01)

(58) Field of Classification Search
CPC ..... F24F 7/02; F24F 13/06
USPC ..... 454/250, 256
See application file for complete search history.

(56) References Cited

U.S. PATENT DOCUMENTS 2,194,878 A * 3/1940 Tracy ..... F24F 13/1413 454/333
2,428,545 A * 10/1947 Breidert ..... F23L 17/02 200/33 B
5,201,685 A * 4/1993 Raisanen ..... F24F 13/1413 454/259
2020/0011555 A1* 1/2020 Mills ..... F24F 7/065

FOREIGN PATENT DOCUMENTS

EP 0607791 B1 * 4/1996 ..... F24F 7/02
GB 2040034 A * 8/1980 ..... F24F 7/02
GB 2336202 A * 10/1999 ..... F24F 11/0001

* cited by examiner

*Primary Examiner* — Avinash A Savani
*Assistant Examiner* — Dana K Tighe

(57) ABSTRACT

This application discloses a wind pressure-driven air intake device for natural ventilation of zero power consumption. Such a device comprises multiple tunnels being arranged around a common central chamber, each having an inflow valve at its inner end connecting the central chamber and an outer end open to ambient airflow. The inflow valve allows only inward flow from a corresponding tunnel into the central chamber. The central chamber has an opening allowing airflow exit to a space to be ventilated. The device is capable of capturing ambient wind flow and wind pressure to be fed to the vented space regardless of wind flow direction towards the device, with no need for a powered air driver.

23 Claims, 6 Drawing Sheets

(B-B view
from Fig. 1a)

(A-A view
from Fig. 1b)

(B-B view
from Fig. 2a)

(A-A view
from Fig. 2b)

(B-B view
from Fig. 3a)

(A-A view
from Fig. 3b)

(B-B view
from Fig. 5a)

(View A
from Fig. 5b)

WIND PRESSURE-DRIVEN AIR INTAKE DEVICE

1. CROSS-REFERENCE TO RELATED APPLICATIONS

This application is entitled to the benefit of a China patent application: Patent No. ZL 2020 2 0003740.1, Publication Date 2020 Aug. 11, Publication No. CN 211233238 U, patent application filed 2020 Jan. 2.

BACKGROUND

Field of Invention

This invention relates to an air intake device, which can be utilized in the field of air ventilation for buildings, industrial and agricultural facilities and vehicles.

Discussion of Prior Art

In ventilation, besides exhaust outlets, air inlets or air intakes are also essential. Their aerodynamic characteristics are important to their performance, particularly for natural ventilation, where no powered air driver, such as an electric fan or blower, is required or used, and where an air intake relies on uncertain external wind flow that can come in one of many possible directions and in different strengths. This leads to a challenge of turning such uncertainties into a certainty of an intake being always an intake, and not being nullified or even adversely becoming an unwanted exhaust outlet.

No prior art is found by this inventor that overcomes such a challenge for an air intake without the assistance of a powered air driver or a moving vehicle/carrier. Some past patents have disclosed various air inlets that rely on powered ventilation or moving vehicle/carrier (U.S. Pat. Nos. 10,883,718; 10,807,131; 05,236,391; 05,088,388; and 04,242,951), or air inlets that are effective for natural ventilation only within one small azimuthal range of wind directions (U.S. Pat. Nos. 08,292,707; 06,578,325; 06,083,098; and 04,850,265). Some others disclosed certain features for ventilation inlets or outlets or vent caps (U.S. Pat. Nos. 10,746,421; 10,323,418; 10,018,368; and 09,243,813) that provide such other functionalities as preventing pest, debris or rain/snow entry. The disclosure closest to the present invention is in US04,850,265 within the above second group. All these disclosures, however, generally lack structural features and mechanism that overcome the above-mentioned challenge for an air intake.

SUMMARY OF THE INVENTION

For optimal air intake, this application discloses a solution to overcome the challenge posed by the uncertainties in the natural wind, by configuring an aerodynamic device capturing wind pressure and wind flows from any possible directions and redirecting them into a space that needs ventilation, without the necessity of using a powered air driver, eliminating or reducing power consumption.

The device comprises multiple abutting wind collectors being set up around a common central chamber, each preferably being a contracting tunnel inwardly towards the central chamber, and each having a one-way inflow air valve at its inner (and smaller) end conjoining the central chamber that only allows inward flow into the central chamber. The central chamber has an aperture allowing air flow exit to a space to be vented. Each wind collector's outer (and larger) end is open to an external or ambient flow field, from which wind collectors will capture and collect wind flow and positive pressure (at least one of them will capture flow stagnation pressure) under any possible oncoming wind direction towards an object that contains the space to be vented, say a building, and any possible ambient flow field around the object.

One example method to realize this general concept can be a relatively simple device that comprises a base plate, a raised shelter plate in parallel, multiple one-way inflow valves of planar shape set perpendicular to the two plates and around a center space between them so as to form a central air chamber, and multiple web plates extending radially from the valves to the perimeters of the plates, and each connecting the base plate and the shelter plate and separating a pair of adjacent inflow values and their upstream spaces in between the two plates so as to form multiple inwardly contracting air tunnels towards the valves and the central air chamber. Each of the one-way inflow air valves is a pressure-operated valve, only openable towards the central chamber. The base plate has an aperture (as an air exit port) allowing fluid communication between the central chamber and a space external to the device that needs ventilation, which may be through a pipe or another chamber equipped with air filters, snow/rainwater-resistance mechanisms, and/or pest-stopping screens.

The device captures and collects external air flow and positive wind pressure through the multiple air collecting tunnels, at least one of which will capture a positive wind pressure sufficient to open the corresponding one-way inflow valve, with the rest of valves being closed under negative differential pressures, and to feed and pass the air flow and the positive pressure itself into the central chamber and into a connected space needing fresh air, forming a path of inflow and needed pressure gradient. The device does not require an fan or other air-driving equipment to introduce external airflow, so as to achieve zero power consumption.

Objects and Advantages

Accordingly, several objects and advantages of the present invention are:

to provide a foolproof air intake that ensures "positive pressure" at an inlet into a space needing fresh air, under any external wind condition, that is, for all possible wind directions and all non-zero wind speeds, where such a space can be those inside a building, enclosed facility, vehicle, trailer or other such enclosed objects and units;

to provide an air intake of zero power consumption that relies only on external natural wind energy;

to provide an air intake device that obviates any moving parts, such as motor, fan or bearing etc., which are expensive and often represent the sources of mechanical failure and render a system malfunctioned, and thus represents a reliable and durable device of low cost, low maintenance, low failure probability, long life expectancy, and zero mechanical noise;

to provide a device that has relatively simple configuration and the ease to manufacture and install, while still being among the most effective, efficient and useful;

to provide an air intake that can be mounted and used on any surface shape and surface slope as situation requires;

Further objects or advantages are to provide an effective air intake that is among the simplest, most lightweight, most inexpensive to manufacture and convenient to install, of no troublesome moving parts, and zero power consumption, with rainwater, pest and smog infiltration proofing when filters and rain resistant mechanisms are incorporated. These and still further objects and advantages will become apparent from a consideration of the following description and drawings.

GENERAL DESCRIPTION OF THE CONCEPT

This application discloses a solution to overcome the challenge posed by the direction and strength uncertainties in the natural wind, by configuring an aerodynamic device capturing wind pressure and wind flows from any possible directions and redirecting them into a space that needs ventilation, without the necessity of using a powered air driver, eliminating or reducing power consumption.

Such a device comprises multiple abutting wind collectors (201 in FIG. 1*a* for example) being set up around a common central chamber (202), each preferably being a contracting tunnel inwardly towards the central chamber, and each having a one-way inflow air valve (104) at its smaller end conjoining the central chamber that only allows inward flow into the central chamber. The central chamber has an aperture (105) allowing air flow exit to a space that needs ventilation. Each wind collector's larger end is open to an external or ambient flow field, from which wind collectors will capture and collect wind flow and positive pressure (at least one of them will capture stagnation pressure) under any possible oncoming wind direction towards an object that contains the space to be vented, say a building, and any possible ambient flow field around the object. While this invention does not preclude a straight tunnel for the same function, a contracting tunnel is preferred since it is in fact more effective.

The device captures and collects external air flow and positive wind pressure through the multiple air collecting tunnels, at least one of which will capture a positive wind pressure sufficient to open the corresponding one-way inflow valve, with the rest of valves being closed under negative differential pressures, and to feed and pass the air flow and the positive pressure itself into the central chamber and into a connected space needing fresh air, forming a path of inflow and needed pressure gradient. The device does not require an fan or other air-driving equipment to introduce external airflow, so as to achieve zero power consumption.

DETAILED DESCRIPTION OF THE PREFERRED EMBODIMENTS

Figure 1B:
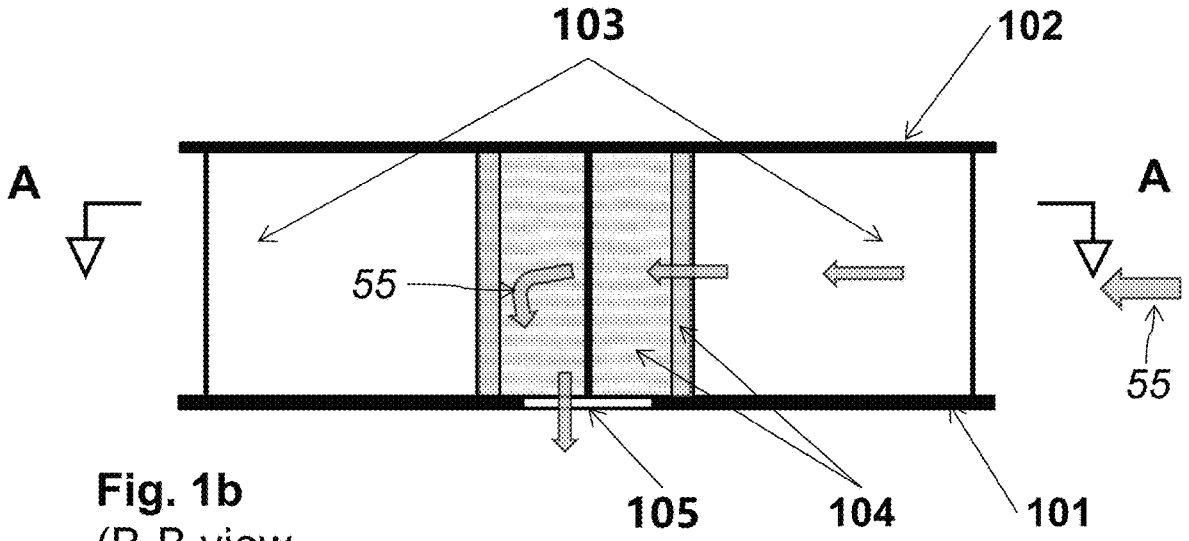
FIGS. 1*a* and 1*b* schematically illustrate a basic embodiment of the present invention.
Figure 1A:
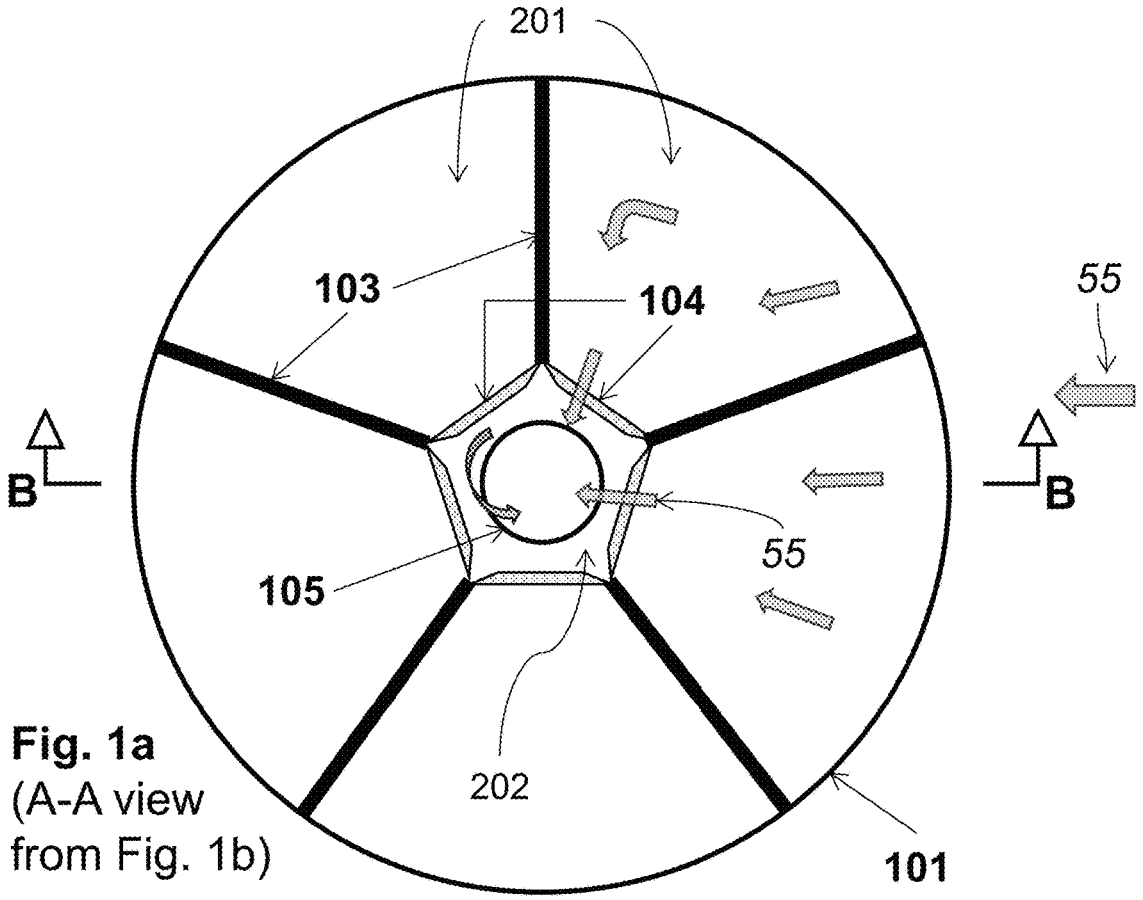

One embodiment of the general concept has been depicted in FIGS. 1*a* and 1*b*, where abutting wind collectors 201 are all arranged to lie between two planar surfaces. Nevertheless, they can be arranged in other fashions according to the spirit of this invention, for example, collectively forming a cube, a spherical or part-spherical body, with some tunnels' longitudinal axes oriented out of plane, say outwardly upwards, or even downwards (if the collective body is raised from a mounting surface with an elongate hollow support that also serves as a conduit for air flow, depending on the use scenario). However, for uses on an open surface, whether a rooftop or a wall, a coplanar or in-plane arrangement is considered more cost effective due to its relative simplicity, since wind flow around a building, or around any enclosed object, is primarily along or in parallel with the building's surfaces, and off-surface or off-plane wind collectors can make contributions only in a very limited number of specific flow states, for example, at very few often-unstable flow reattachment points where significant vertical components of the flow vector would occur.

In the embodiment depicted in FIGS. 1*a* and 1*b*, the relatively simple device according to this invention is formed by comprising a base plate 101, a raised top plate 102 in parallel, multiple one-way inflow valves 104 of planar shape set perpendicular to the two plates 101/102 and around a center space between them so as to form a central air chamber 202, and multiple web plates 103 extending radially from the valves towards the perimeters of the plates 101 and 102, and each connecting the base plate 101 and the top plate 102 and separating a pair of adjacent inflow valves 104 and their upstream spaces in between the two plates 101/102, so as to form multiple inwardly contracting air tunnels 201 towards the valves 104 and the central air chamber 202. Each of the one-way inflow air valves 104 is a pressure-operated valve, only openable inwardly towards the central chamber 202. For example, one relatively simple type of such valves is a shutter having an array of elongate, parallel lightweight flaps. Their hinged, slim flap blades will not extend much inwards into the central chamber 202 when being opened, so that they will not interfere with those of the neighboring valves. The flaps may be arranged horizontally to utilize gravity to assist in maintaining a closed state for most of the valves, but the main action to close a valve will be an outward differential pressure across the valve, without a necessity for springs. The base plate 101 has an aperture 105 as an air exit port allowing fluid communication between the central chamber 202 and a space external to the device, such as a room that needs ventilation, which may be through a pipe or another chamber equipped with air filters, snow/rain-resistance mechanisms, and/or pest-stopping screens.

In a surface-mount in-plane set-up, a device according to this invention normally needs four or more wind collectors to cover the full azimuths of surface flow directions of 360 degrees, particularly in an open surface situation; however, in some use scenarios where dominant surface flow directions exist, for example, in such relatively confined flow region as along an intersection line between a rooftop and a wall rising from the rooftop, this restriction can be relaxed.

As wind-induced flow approaches from one direction, say the direction 55 as indicated in FIGS. 1*a* and 1*b*, at least one of the wind collectors 201, normally the upstream one(s), will capture the wind flow, and the corresponding inflow valve(s) 104 will experience inward differential pressures, under which the valve(s) become open, allowing pressure gradient and airflow to pass them and reach the central air chamber 202 and the air exit port 105, while those downstream valves (104) will close under outward differential pressures, establishing a path for pressure gradient and airflow needed for ventilation of a space connected to the air exit port 105, as indicated by the shaded arrows 55. Pressure gradient and inflow needed in an air intake for ventilation is accomplished in this process through natural wind flow and wind pressure, without power consumption.

The specific forms of construction, shapes, sizes and their proportions as sketched in these figures are merely used as examples to assist in illustrating the general conception of the present invention; variations or modifications to the forms of construction, shapes, sizes and dimensional proportions are possible and allowable according to the spirit of this invention without jeopardizing the above-described mechanism and functionalities, as long as a working configuration is achieved to realize the described principles and mechanic process.

Figure 2B:
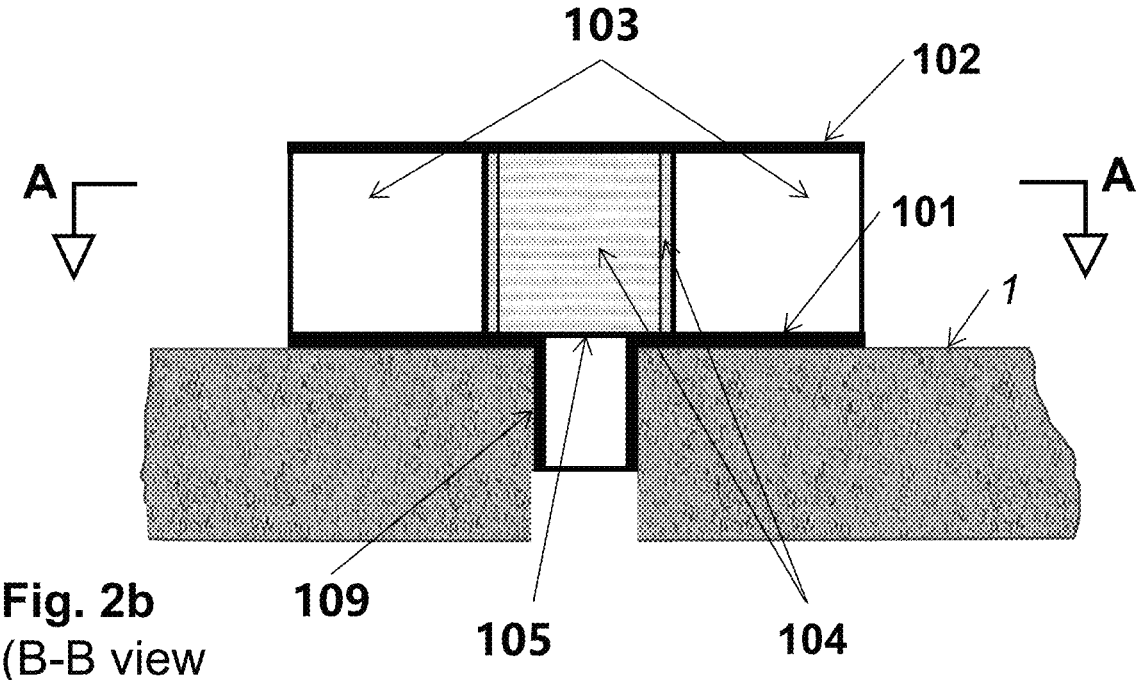
FIGS. 2*a* and 2*b* show another example to form a pressure-driven air intake according to the present invention, shown being mounted on a rooftop merely for illustration purposes.
Figure 2A:
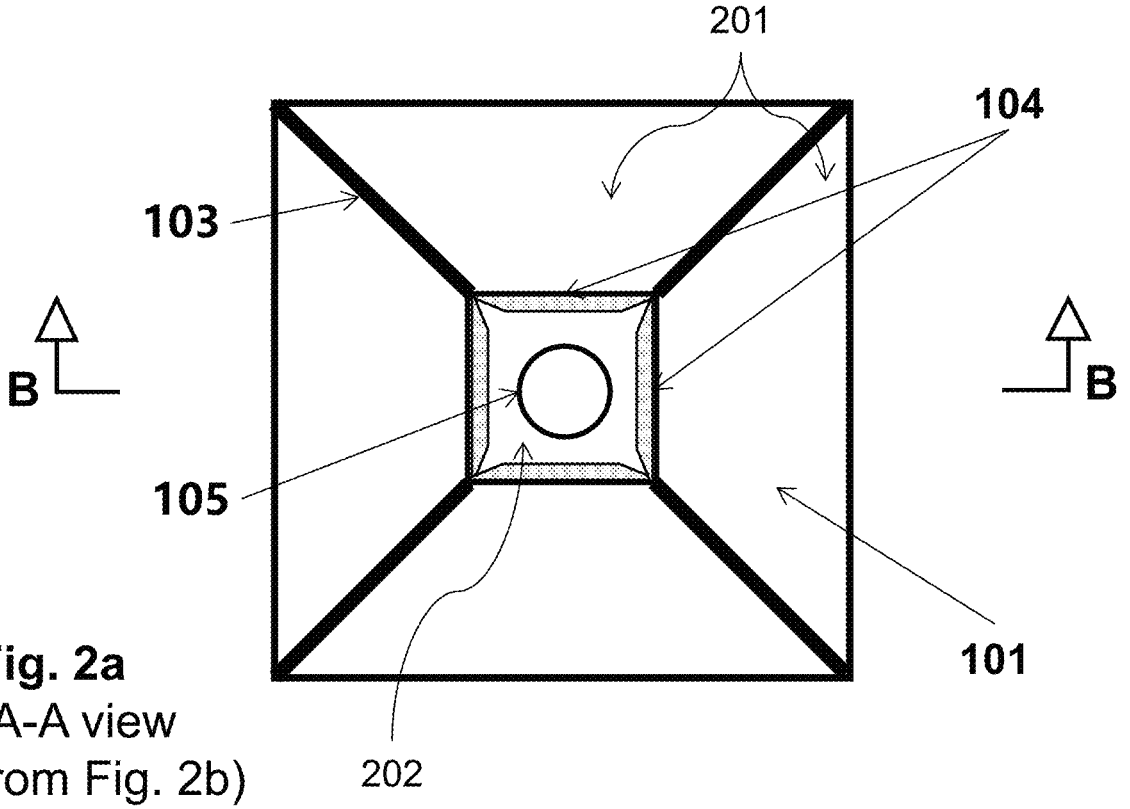

An alternative working configuration is presented in FIGS. 2*a* and 2*b*, where the device is shown being secured on a rooftop 1, and a pipe 109 as an air conduit is also shown being extended from the air exit port 105, both merely for illustration purposes. Note that, the same indicating numeric is used for similar parts or elements throughout the figures in the application. This alternative configuration includes four wind collectors 201, and corresponding numbers of web plates 103 and inflow valves 104. It still accomplishes the process and provides the functionalities similar to that illustrated in FIGS. 1*a* and 1*b* without departing from the spirit of the present invention.

In the above figures, many parts are illustrated using straight lines and plane surfaces; however, curved lines and arched surfaces are allowable as long as they conform to the general configuration described and will not jeopardize or compromise the described mechanism and functionalities. Similarly, non-smooth surfaces, such as roughened, corrugated or ribbed, as well as rounded or chamfered edges and corners, can be utilized for various purposes—whether architectural, aerodynamic, acoustic or else, for example for flow separation control, airflow guide or aerodynamic noise prevention etc., as long as such local additions do not affect the described essential mechanisms significantly.

Figure 3B:
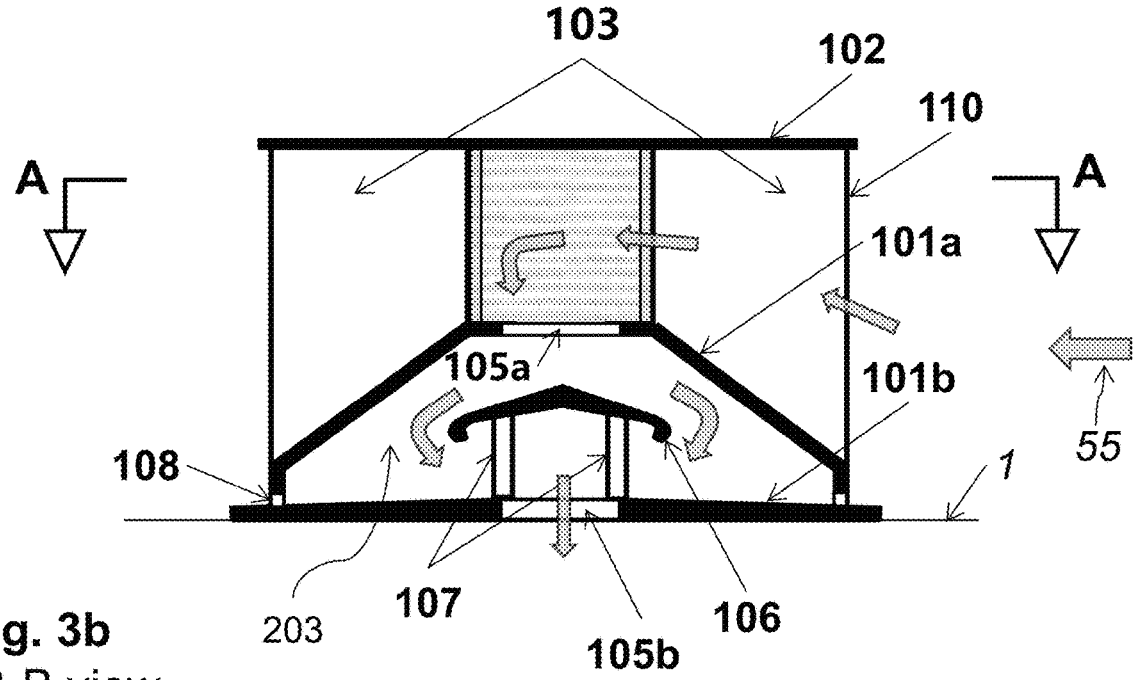
FIGS. 3*a* and 3*b* illustrate an embodiment that includes a rain/snow proof mechanism and debris/pest-stopping screens.
Figure 3A:
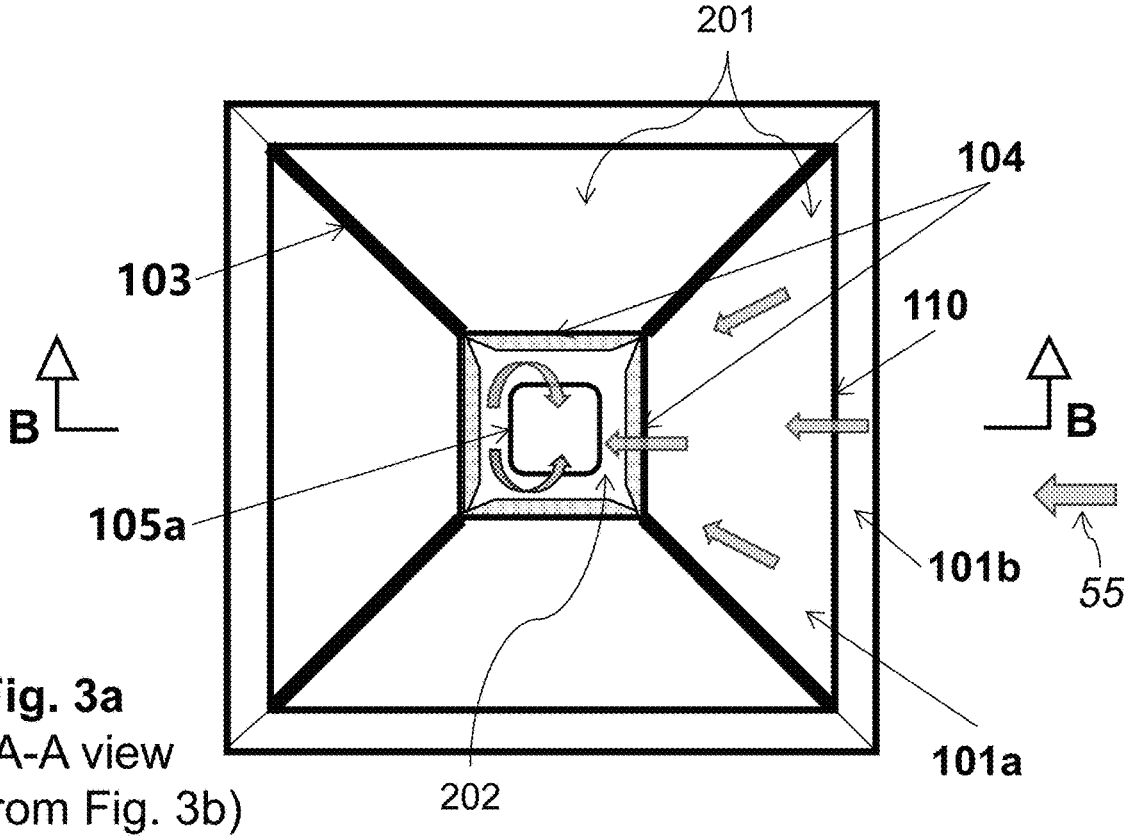

Rainwater/snow-proof mechanisms, including some that can be found in prior art, could be incorporated in such basic configurations of this invention as the one depicted in FIGS. 1*a* and 1*b*, or that in FIGS. 2*a* and 2*b*. As an example, FIGS. 3*a* and 3*b* illustrate a device with an internal cap 106 being placed inside a lower housing or chamber 203 on the air path between a first exit port 105*a* and a second air exit port 105*b*. Residual rainwater or melt snow water having escaped upstream parts is allowed to enter the lower chamber 203 through the first exit port 105*a* but is shielded from exiting to the ventilated space through the second exit port 105*b* by the cap 106. Water having been shielded by the cap 106 will drop from the edge of the cap onto the slightly sloped upper surface of a base plate 101*b*, and drain out through small orifices 108 on the lower perimeter of the lower chamber 203.

In addition, to stop snow, pests and debris from entering the device and the vented space, fixed or removable screens of appropriate mesh size can be equipped to cover the open ends 110 of the wind collectors 201, as indicated in FIG. 3. The debris is not as easy to accumulate on such an outer screen and convenient to be cleaned off, compared to having screens on any downstream locations within the device although it is technically feasible to do so.

Figure 4:
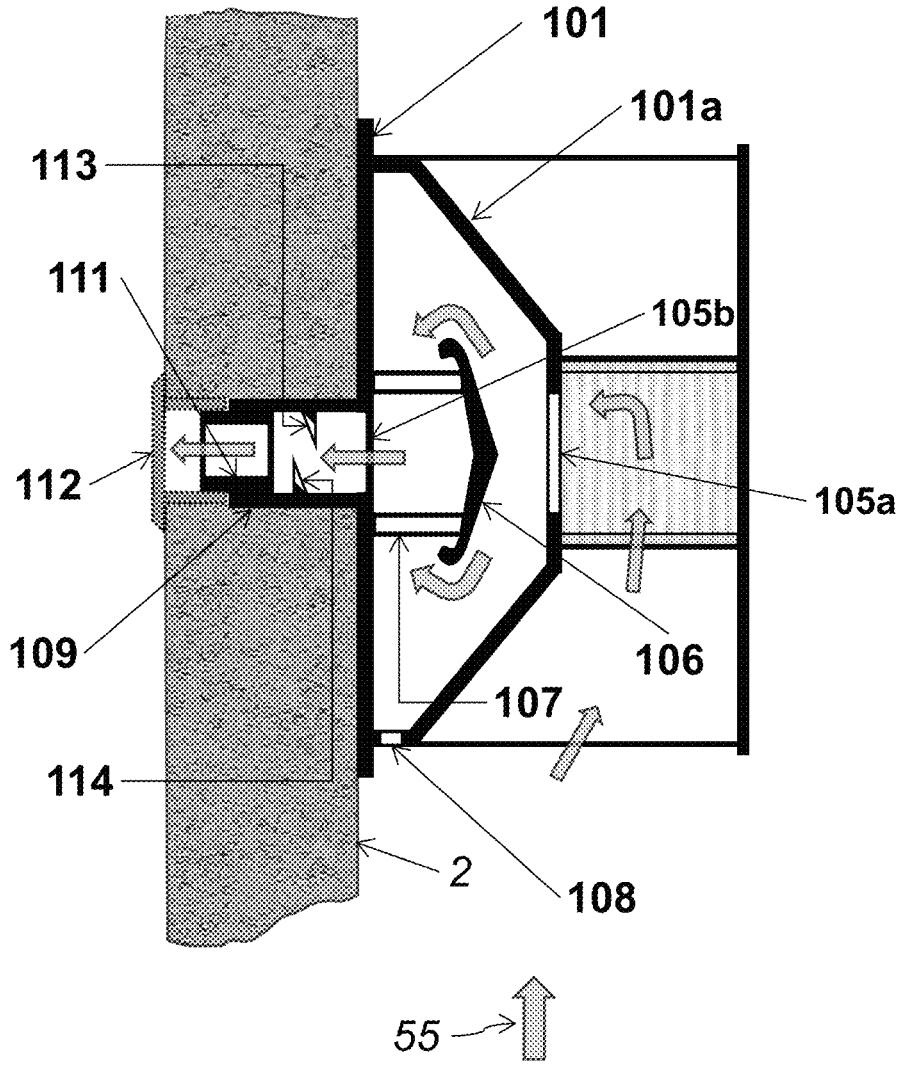
FIG. 4 depicts an alternative configuration that has alternative rainwater proof mechanism along with an air filter, being secured on an exterior wall merely for illustration purposes.

FIG. 4 depicts another example of the device according to the present invention, shown as being mounted onto an exterior wall 2 merely for illustration purposes. As in previous figures, shaded arrows 55 indicate an approaching wind flow direction and approximate airflow paths within the device under this wind flow direction. For illustration purposes, a scenario of an updraft along the exterior wall surface (2) is depicted herein, which is an frequent occurrence for an upper or top wall portion of a building.

A removable air filter 112 is included in the illustration of FIG. 4, which is fitted to the extension pipe 109 with a coupler 111 merely as an example to showcase the use of an air filter in the system. An advantage of having an air filter at this location is its convenient maintenance and replacement from inside a building, particularly in the case for a wall mount use of the device. Other optional locations are entirely possible and feasible, and should be considered according to a specific situation where a device of this invention is used.

For wall mount use in general, the drain orifice 108 at the bottom may be a controlling, or the only effective, drain path for invaded snow or rain water, and an appropriately larger orifice size is necessary thereon while no drain orifice elsewhere is necessary.

Alternative rainwater-proof mechanisms can also be used at a location along the airflow path for a wall mount setting. In FIG. 4, for example, a drip edge 113 is added on the upper inner wall of the extension pipe 109, and a ridge dam 114 (shaped similar to a drip edge) is added on the lower inner wall of the extension pipe 109. With this alternative rainwater-proof mechanism, the internal cap 106 with its supports 107, along with the outer cover 101*a* of its housing chamber, could be eliminated for simplicity and/or cost saving reasons. In such case, the aperture 105*a* would be directly on the base plate 101 and connected to the extension pipe 109, much in the same fashion as in FIG. 2 (aperture 105 therein).

An on-and-off switchable shutter, such as a conventional type of tethered and sprung flap shutter, can also be added at a location on the airflow path to turn the intake on or off as needed. Preferred optional locations include those airflow path locations at, or downstream of, the air exit port 105*b*.

Figure 5B:
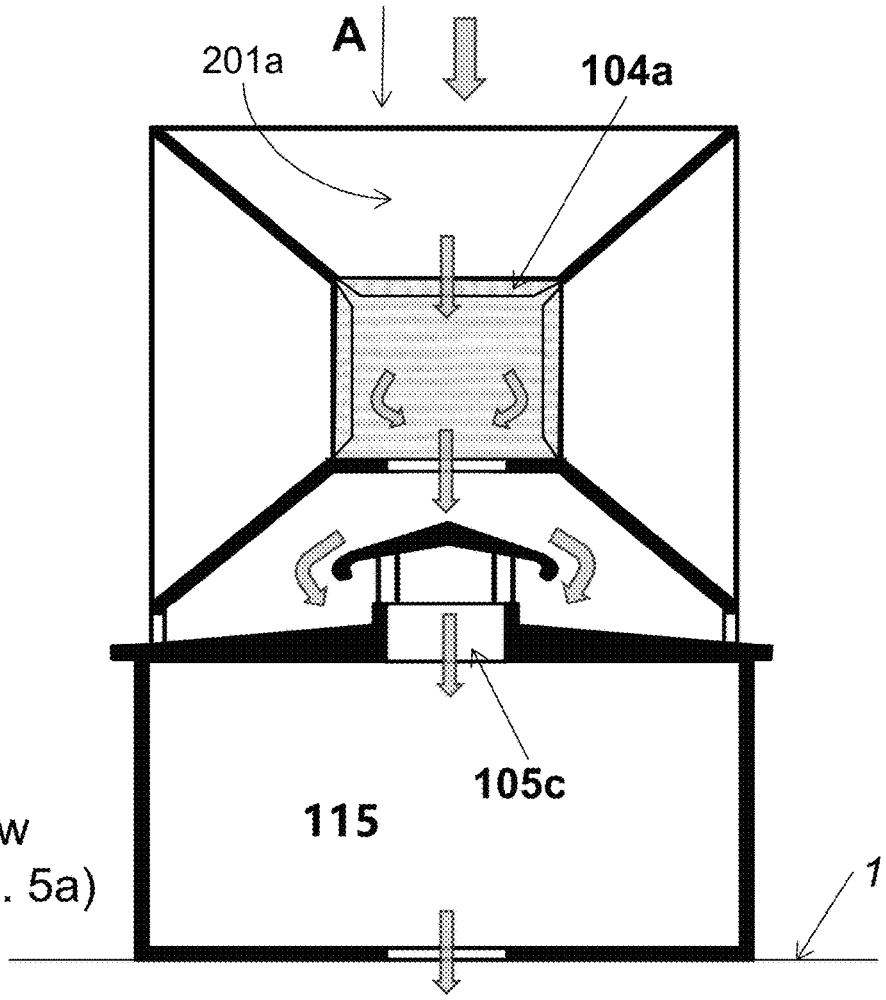
FIGS. 5*a* and 5*b* show an embodiment having an upper wind collector, useful in situations where down wash flow is anticipated. The device shown rises up from a mounting surface and has a lower supporting hollow box that also functions as an airflow duct.
Figure 5A:
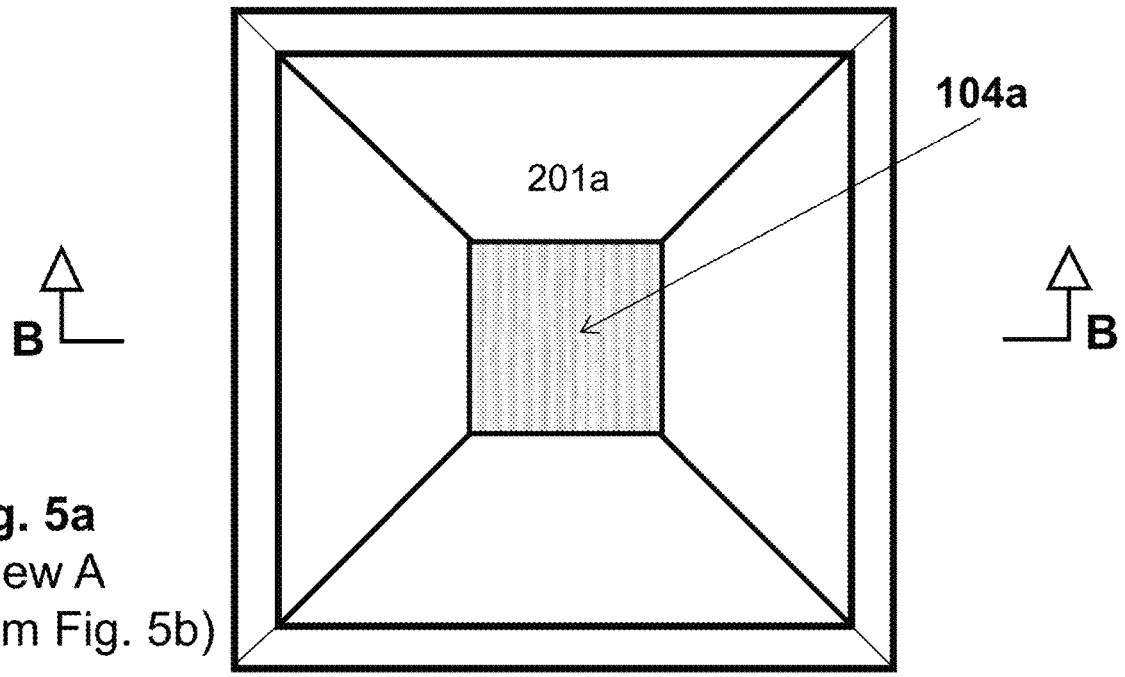
Figure 6:
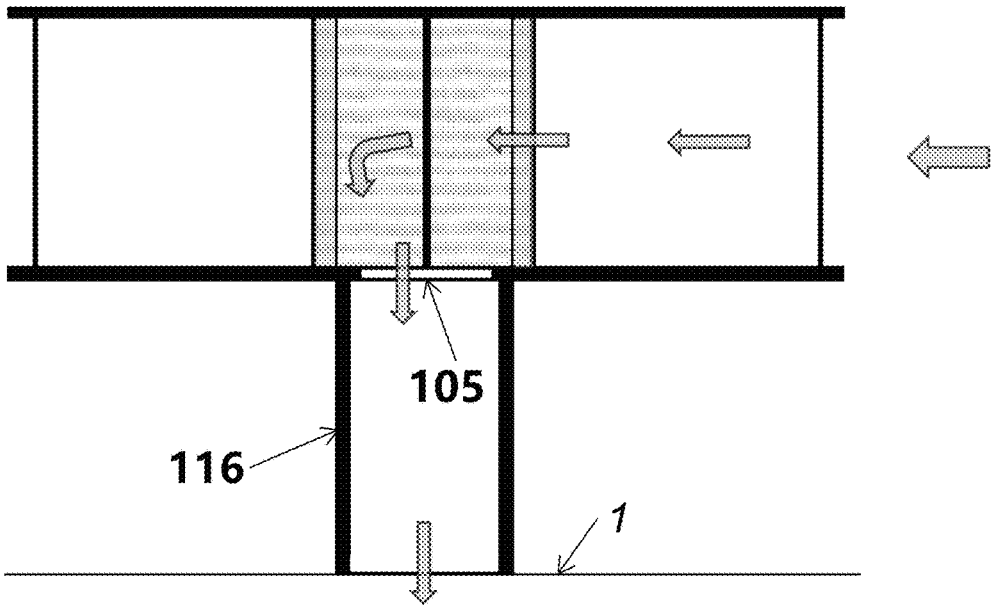
FIG. 6 shows another example of the device being elevated from a mounting surface.

In FIGS. 5*a* and 5*b*, an embodiment further exemplifies the invention with an upper wind collector 201*a* (and corresponding valve 104*a*) being incorporated that has its longitudinal axis being off-plane with rest of wind collectors'. Such setting is useful in situations where three-dimensional off-plane flows, such as down wash or reattached flow, are anticipated. A collared aperture 105*c* is used to stop invaded rainwater from entering a space being vented. As may be desired in some cases, the device shown herein rises up from a mounting surface 1 and has a lower supporting hollow box 115 that also functions as an airflow duct, so does that in FIG. 6 with an elongate hollow body 116, allowing air exit to a space to be vented.

Installation and Operation

In principle, an air intake device according to this invention is functional anywhere on an exterior surface of an object, such as a building, whether rooftop or wall, a land or sea vehicle, whether top or side, or other facilities or carriers where there are relative air movements caused by either wind or the movement of the object itself. Locations with frequent high surface airflow velocities are optimal locations for device deployment.

Air intake devices according to this invention are passive, flow-activated and pressure-operated devices. Once installed properly, they stay operating and functioning as wind blows, and do not require active intervention besides infrequent and minimal air valve maintenance, debris clean-off, and air filter replacement if any. The stronger the wind blows, the more effective this wind pressure-driven air intake is.

CONCLUSION, RAMIFICATIONS, AND SCOPE

It is apparent that a wind pressure-driven air intake device of this invention provides a device of highly desirable characteristics that is aerodynamically advantageous, power conserving, rainwater-proof and nearly noise-free, and is still among the simplest, most inexpensive to manufacture and convenient to install.

Although the description above contains many specifications, these should not be construed as limiting the scope of the invention but as merely providing illustrations of some of the presently preferred embodiments of this invention. Various changes, modifications, variations can be made therein without departing from the spirit of the invention. For example, the edges and corners of device parts exposed to airflow can be rounded or chamfered to improve aerodynamic performance and further ensure its noise-free quality even for ultra high wind conditions. Various surface portions may also be roughened or bear such surface details as corrugation, or ribs of adequate sizes, as opposed to perfectly smooth surfaces, sometimes for surface flow controls.

The air intake device can be made of any reasonably durable material with any proper means of fabrication as long as a configuration according to the spirit of this invention is accomplished to support the described working mechanism and to provide the associated functionalities.

Any appropriate conventional or new surface-mounting method can be used to secure the device to a surface without departing from the spirit of this invention. If required or desired in certain circumstances, the device can also be elevated from the mounting surface, and supported and secured by a hollow body, such as a tube or box, extended between the air exit port and the mounting surface such that the support also functions as an air conduit there-between. An on-and-off switch, such as a conventional type of tethered flap shutter, can also be added to somewhere on the airflow path to turn the intake on or off as needed.

Thus, the scope of the invention should be determined by the appended claims and their legal equivalents, rather than by the above illustrations given as examples.

I claim:

1. A natural wind pressure-driven air intake device, comprising:

a plurality of tunnels arranged around a common chamber, each said tunnel having an inflow valve at its inner end connecting said common chamber and an outer end open to ambient air, said inflow valve allowing only inward flow from said tunnels into said common chamber, said common chamber having an aperture allowing airflow exit to a space to be ventilated, wherein said inflow valve comprising a plurality of elongate flaps.

2. The device of claim 1, wherein at least one of said tunnels contracting inwardly with its said inner end being smaller than said outer end.

3. The device of claim 1, wherein longitudinal axes of said plurality of tunnels being coplanar.

4. The device of claim 1, wherein a longitudinal axis of at least one of said plurality of tunnels being out of plane with longitudinal axes of rest of said plurality of tunnels.

5. The device of claim 1, wherein said elongate flaps being arranged horizontally.

6. The device of claim 1, wherein said device being facilitated with at least one protection screen.

7. The device of claim 6, wherein said protection screen being facilitated at said outer end of at least one of said plurality of tunnels.

8. The device of claim 1, wherein said device being facilitated with an air filter.

9. The device of claim 1, wherein said device being facilitated with an on/off switchable shutter to switch on or off said device.

10. The device of claim 1, wherein said device being elevated with at least one hollow support allowing fluid communication between said common chamber and said space to be ventilated through said aperture and said hollow support.

11. The device of claim 1, wherein said aperture being facilitated with a collar around its perimeter, to prevent rainwater from dripping into said space to be ventilated through said aperture.

12. The device of claim 1, wherein a plate surrounding said aperture having an upper surface sloped downwardly and outwardly, to prevent rainwater from dripping into said space to be ventilated.

13. A natural wind pressure-driven air intake device, comprising:

a plurality of tunnels arranged around a common chamber, each said tunnel having an inflow valve at its inner end connecting said common chamber and an outer end open to ambient air, said inflow valve allowing only inward flow from said tunnels into said common chamber, said common chamber having an aperture allowing airflow exit to a space to be ventilated, wherein said aperture being connected with a second chamber allowing fluid communication between said common chamber and said second chamber, and said second chamber having a second aperture allowing fluid communication between said second chamber and said space to be ventilated, wherein a cap being supported over said second aperture inside said second chamber, said cap being larger in diameter than said second aperture.

14. The device of claim 13, wherein at least one of said aperture and said second aperture being facilitated with a collar around its perimeter, to prevent rainwater from dripping into said space to be ventilated.

15. The device of claim 13, wherein at least one of a plate surrounding said aperture and a base plate surrounding said second aperture having an upper surface sloped downwardly and outwardly, to prevent rainwater from dripping into said space to be ventilated.

16. A natural wind pressure-driven air intake device, comprising:

a plurality of tunnels arranged around a common chamber, each said tunnel having an inflow valve at its inner end connecting said common chamber and an outer end open to ambient air, said inflow valve allowing only inward flow from said tunnels into said common chamber, said common chamber having an aperture allowing airflow exit to a space to be ventilated, wherein said aperture being connected with a second chamber allowing fluid communication between said common chamber and said second chamber, and said second chamber having a second aperture allowing fluid communication between said second chamber and said space to be ventilated, wherein at least one drain orifice being facilitated at a lower perimeter of said second chamber.

17. The device of claim 16, wherein at least one of said aperture and said second aperture being facilitated with a collar around its perimeter, to prevent rainwater from dripping into said space to be ventilated.

18. The device of claim 16, wherein at least one of a plate surrounding said aperture and a base plate surrounding said second aperture having an upper surface sloped downwardly and outwardly, to prevent rainwater from dripping into said space to be ventilated.

19. A natural wind pressure-driven air intake device, comprising:

a plurality of tunnels arranged around a common chamber, each said tunnel having an inflow valve at its inner end connecting said common chamber and an outer end open to ambient air, said inflow valve allowing only inward flow from said tunnels into said common chamber, said common chamber having an aperture allowing airflow exit to a space to be ventilated, wherein said aperture being connected with a second chamber allowing fluid communication between said common chamber and said second chamber, and said second chamber having a second aperture allowing fluid communication between said second chamber and said space to be ventilated, wherein said second aperture being connected with a tube extending away from said second chamber, wherein said tube having at least one rainwater-proof mechanism.

20. The device of claim 19, wherein said rainwater-proof mechanism comprising at least one drip edge on an inner wall of said tube.

21. A natural wind pressure-driven air intake device, comprising:

a plurality of tunnels arranged around a common chamber, each said tunnel having an inflow valve at its inner end connecting said common chamber and an outer end open to ambient air, said inflow valve allowing only inward flow from said tunnels into said common chamber, said common chamber having an aperture allowing airflow exit to a space to be ventilated, wherein said aperture being connected with a tube extending away from said common chamber, wherein said tube having at least one rainwater-proof mechanism.

22. The device of claim 21, wherein said rainwater-proof mechanism comprising at least one drip edge on an inner wall of said tube.

23. A natural wind pressure-driven air intake device, comprising:

a plurality of tunnels arranged around a common chamber, each said tunnel having an inflow valve, an inner end connecting said common chamber and an outer end open to ambient air, said inflow valve allowing only inward flow from said tunnels into said common chamber, said common chamber having an aperture allowing airflow exit to a space to be ventilated, wherein said inflow valve comprising a plurality of elongate flaps.

* * * * *